United States Patent [19]

Raschke

[11] 3,978,786

[45] Sept. 7, 1976

[54] COPY AND REUSABLE MASTER MAKING SYSTEM APPARATUS FOR PREPARING A PERMANENT IMAGE

[75] Inventor: Curt Robert Raschke, Warrensville Heights, Ohio

[73] Assignee: Addressograph Multigraph Corporation, Cleveland, Ohio

[22] Filed: Nov. 15, 1974

[21] Appl. No.: 524,232

[52] U.S. Cl. ..... 101/114; 101/DIG. 13; 118/637; 355/3 DD

[51] Int. Cl.[2] ..... G03G 15/00

[58] Field of Search ..... 427/14; 101/DIG. 13, 101/114; 355/3 DD, 17; 118/637

[56] References Cited

UNITED STATES PATENTS

| | | | |
|---|---|---|---|
| 3,285,168 | 11/1966 | Childress | 101/DIG. 13 |
| 3,340,802 | 9/1967 | Pilon | 101/DIG. 13 |
| 3,582,206 | 6/1971 | Burdige | 355/16 |
| 3,645,614 | 2/1972 | McFarlane | 355/3 |
| 3,647,291 | 3/1972 | Pressman et al. | 355/3 |
| 3,665,856 | 3/1972 | Heller | 101/DIG. 13 |
| 3,737,222 | 6/1973 | Briggs et al. | 355/17 |
| 3,779,166 | 12/1973 | Pressman et al. | 101/DIG. 13 |
| 3,797,926 | 3/1974 | Fotland et al. | 355/17 |
| 3,824,010 | 7/1974 | Pressman | 101/DIG. 13 |
| 3,843,250 | 10/1974 | Fotland et al. | 355/3 DD |

*Primary Examiner*—Bernard D. Pianalto
*Attorney, Agent, or Firm*—Ray S. Pyle

[57] ABSTRACT

An apparatus used in the formation of visible copies of an image, the establishment of an electric field embracing a screen laden with toner material and a platen supporting a receiving sheet, and spraying ions in an image formation upon the toner on the screen in a sign which will cause the resultant toner particles to be impelled by the field upon the sheet.

3 Claims, 2 Drawing Figures

COPY AND REUSABLE MASTER MAKING SYSTEM APPARATUS FOR PREPARING A PERMANENT IMAGE

BACKGROUND OF THE INVENTION

In conventional plain paper electrostatic photography, an insulating photoconductor is charged with a corona source of ions, exposed, the charge image developed, the developed image transferred to plain paper, and finally, the toned image is fixed, generally by fusing. After the transfer operation, the residual image is erased from the surface of the photoconductor and the photoconductor is cleaned in preparation of a repetition of the process. Although employing plain paper, this process is complicated by the requirement for a number of different machine operations. In addition, the photoconductor suffers wear over a period of time, because the surface of the photoconductor is repeatedly rubbed by toner particles, cleansing brushes and paper surfaces.

A related process employs a photoconductively coated paper. The photoconductor, generally zinc oxide, is first charged, then exposed, and the image toned. The photoconductor is not reusable and thus the wear and tear restrictions are eliminated. In addition, the four-step machine operation is simplified. The disadvantage of this process is associated with the requirement for coating the paper with a photoconductor. Photoconductively coated papers are significantly more expensive than plain, uncoated paper. In addition, because of the heavy coating the papers are heavy and have a feel quite different from plain paper.

U.S. Pat. No. 3,797,926 teaches a solution of these problems by use of an improved corona modulating screen consisting of a plurality of strands with a photoconductive coating on the strands which is asymmetrical by being offset from a plane passing through the strands and perpendicular to the plane of the screen, when the screen is viewed in cross section.

There is an alternate teaching in this prior art U.S. Pat. No. 3,797,926, and that is directed to the concept of producing the toned image directly upon paper rather than first creating an electrostatic image which is later supplied with toner.

The teaching is that either a fully insulating dacron or nylon screen, or fully conducting phosphor bronze or stainless steel screen could be used as a mechanical carrier to position finely divided toner particles in the modulated corona stream. The suggestion is that the toner particles will pick up the charge normally sprayed onto the receiving sheet, and then the charged toner particles would be attracted to the carrier sheet rather than just the ions. This additional teaching ostensibly eliminates a separate toning step.

SUMMARY OF THE INVENTION

Without passing upon the quality or feasibility of the modified step of the prior art to produce an image directly by ion charging of toner particles, this invention has for its advantage the provision of an improved means for placing toner particles in an ion image spray field in order to produce a superior direct image result.

A further advantage and object of this invention is obtained by the capability of placing an image on surfaces not usually considered receptive to toner imaging. Therefore, it is an object of this invention to combine the improved imaging technique with a reusable polysiloxane or teflon film master, which may thereafter be cleaned after serving its function as a master, and reused. Teflon is the registered trademark of the Dupont Corporation for tetrafluoroethylene fluorocarbon polymers (TFE).

As in prior practice a fine mesh screen or grid coated with a photoconductor is employed to spatially modulate the flow of corona current in accordance with an optical image projected onto the fine mesh screen or grid.

The use of a fine wire mesh or screen, the surface of which is coated with a light-sensitive material, it is described in U.S. Pat. No. 2,676,100 and in U.S. Pat. No. 3,220,324 as well as the more directly related U.S. Pat. No. 3,797,926.

The prior art has taught the use of photoconducting coatings on ion modulating screens for imaging surfaces and has taught the provision of special coating configurations, as in U.S. Pat. No. 3,797,926. This invention is concerned with the efficient: (1) release of toner from a fine mesh screen by ion effect, and, (2) production of field effect transfer of the ion charged toner to a carrier.

By this invention, an improvement in dry electrostatic and wet ink masters is provided, which are recyclable for new image impressions and reuse.

DESCRIPTION OF THE PREFERRED EMBODIMENT

The purpose of this invention is to develop the latent image formed by an ion modulator directly onto a carrier sheet. In this way, a transfer step is avoided and the image can be developed as rapidly as the latent image can be deposited. This statement, of course, is substantially a description of prior art U.S. Pat. No, 3,797,926. The difference is in the construction, operation, and result of the new and improved screen 10 used to physically hold a supply of toner particles, and to take part in the production of a propelling electric field.

This invention will lead to very fast production of copies, useful for producing plain paper copies or masters. In addition, faithful reproduction can be obtained since there if a one-to-one correspondence between the charged density of the latent image and the amount of toner deposited.

Figure 1:
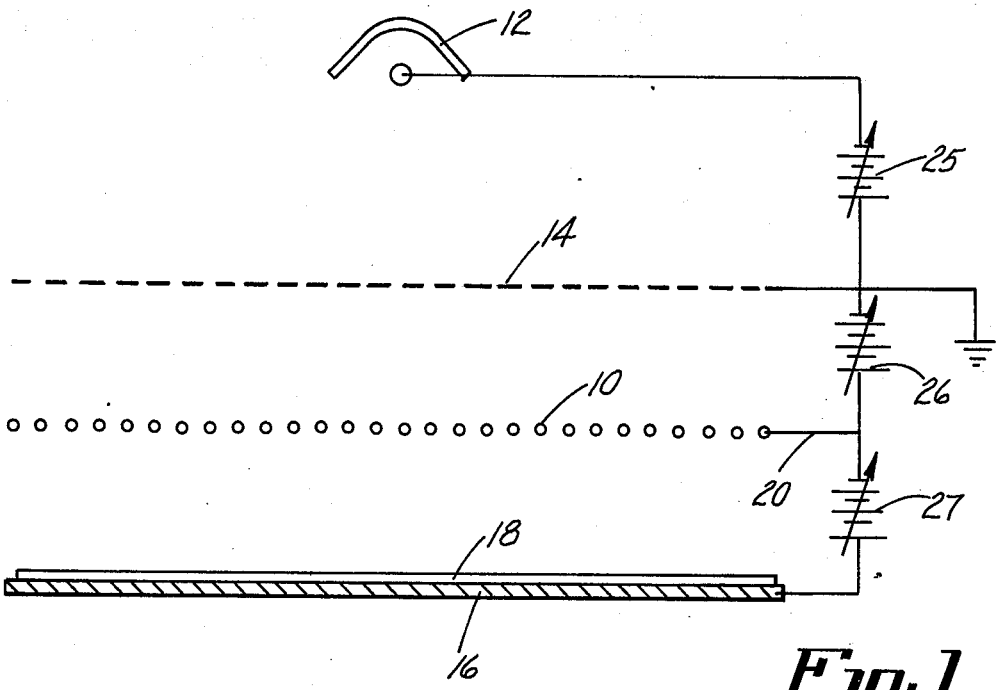
FIG. 1 is a schematic view of an apparatus for preparing electrostatic images corresponding to a projected optical image upon an image-receptive surface.

In FIG. 1 of the drawing, there is shown a corona 12, and ion modulator 14 which can be either a stencil or imaged photoconducting screen. It is the screen 14 with which the prior art Pat. No. 3,797,926 is more directly concerned.

The FIG. 1 also shows a metal collecting plate 16 and a receiving sheet 18. The sheet 18 may be any desired receiving surface. The prior art has been concerned about plain paper copies, and usually illustrates the carrier sheet as such plain paper. In addition, this invention teaches the concept of placing a sheet which may be used as a lithographic or electrostatic master in the position of the sheet 18. If the carrier sheet 18 has a background surface which has a very low adhesion for grease type inks, for example, and the toner material for the image has a high affinity for grease type inks, then the sheet may be employed in an offset printing press without the use of moisture to prevent toning of the background during the printing cycle.

Likewise, if the carrier sheet is conducting and the image is insulating, then the master sheet may be given a blanket corona charge, but only the image will hold that charge, and therefore may be toned and pressed against a receiving sheet to produce multiple copies of electrostatic toner material imaging.

To produce such a master, however, a higher than normal resolution must be obtained because each step in any process runs the risk of deterioration of quality. Hence, a copy which might be satisfactory in the prior art for a plain paper copy, is not necessarily satisfactory for an electrostatic or planographic master sheet. This invention provides the high and faithful resolution.

Figure 2:
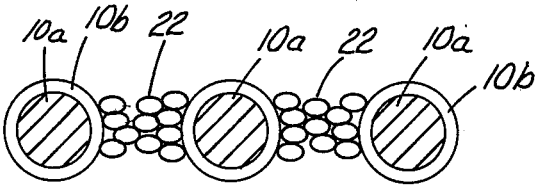
FIG. 2 is a cross section view of a toner carriage screen illustrating the field effect structure thereof.

FIG. 2 of the drawing is an enlarged section of a portion of the screen 10. The screen is a metal core woven screen indicated by the reference character 10*a* and is provided with a terminal 20 for connecting the screen to an electrical potential source. The screen is uniformly coated with an insulation layer 10*b* in order that the electrical potential is completely insulated and out of contact with any toner held by the screen.

Toner particles are indicated by the reference character 22 stacked and collected between the webbing of the screen. The finer the mesh size of the screen 10, the better will be the resolution provided by the apparatus. Screens as fine as 1000 wires per linear inch are known, but with insulation material as shown in FIG. 2, the numbers will be fewer than 1000. The technique used for insulating the wire and the care taken in doing the insulation will determine the number of wires and the thickness of insulation material to produce the actual finished material which should produce a resolution of two-to-four line-pairs/mm as a maximum, whereas more insulation or finer mesh screen is capable of providing seven-to-fourteen line-pairs/mm.

A corona high-voltage supply 25, a toner screen high-voltage supply 26 and a collector plate high-voltage supply 27 provide the proper bias and power for operation of the device.

As a specific example, a toner screen 10 of 200 mesh woven stainless steel with each wire overcoated with three-to-four micron thickness polyethelene coating will provide good results. The holes between the wires filled with toner as shown by U.S. Pat. No. 3,764,538 was used, although toners supplied by IBM Corporation and Xerox Corporation were also tested satisfactorily.

With a plus 2000 volt potential between the screen 14 and the screen 10, and a positive charge of 6000 volts between the screen 10 and the plate 16, and a negative spray from the ion corona device 12, produced excellent results. Likewise, a negative voltage of 2000 volts between the screen 14 and the screen 10 and a negative potential of 6000 volts between screen 10 and a base 16 produced excellent results with a positive spray corona from the device 12.

The spray corona provides about one-half microamp/cm$^2$. This current density provides an image density on the receiving surface of 1.0 in one second.

The corona produces ions which fall on the ion modulator 14 (the charge sign depends on the sign of the power supply 25). Those ions which pass through the modulator 14 are accelerated toward the toner screen 10, which is kept at a potential opposite in sign to the corona ions by the high voltage supply 26.

Because the screen coating and toner are insulating, the toner which is hit by the ions charges up and takes the charge sign of the ions. If now the collector plate is biased by the power supply 27 so that the potential difference between the collector plate 16 and the toner screen 10 is opposite to the sign of the ions, there will be a field which will accelerate the charged toner onto the paper in an image-wise fashion. It has been found and confirmed by actual trial, that neither a conducting screen 10, uninsulated, or a non-conducting screen 10, cannot produce useful results, whereas the conducting screen, fully insulated and electrically coupled with collector plate 16 produces predictable and repeatable results.

The toner screen 10 thus serves as a conversion device which converts the modulated ion stream into a modulated toner stream which can be deposited directly onto any type of surface, including plain paper or master surfaces.

The density of the resulting copy can be controlled by (1) controlling the amount of toner held by the screen, or (2) by controlling the ion charge reaching the toner screen 10 by varying the current from the corona or controlling the electric field between the modulator 14 and the toner screen 10. The contrast of the final copy can be controlled by varying the electric field between the collector plate 16 and toner screen 10.

What is claimed is:

1. An apparatus for preparing a permanent image on a carrier sheet confirming to an optical image, comprising:

an electrically conductive platen adapted to support an image receiving carrier member;

a corona source adapted to spray ions toward said image receiving member;

a corona modulating screen disposed between said corona source and said image receiving member;

a toner carriage screen positioned between said modulating screen and platen, said screen having a high resolution of small openings for holding toner particles clinging thereon and bridging said openings, said screen having a conducting core with an insulating coating; and means for impressing a first field potential between the corona source and said modulating screen in a direction to impel ions toward said platen, a separate second field potential between said modulating screen and said toner carriage screen of complementary direction to said first field, and a separate third field potential between said toner carriage screen and said platen of complimentary direction to said second field for causing said corona to emit ions of a charge to be attracted to said platen;

whereby toner particles on said carriage screen struck by corona ions passing through neutralized portions of said modulating screen will be ionized to a charge which will cause them to be propelled by said field toward said platen.

2. In an apparatus as defined in claims 1, said toner carriage screen being a conducting core with a fully insulating jacket, whereby toner thereon is electrically separated from the electrical circuit producing the field.

3. An apparatus for preparing a permanent image on a carrier sheet conforming to an optical image, comprising:

an electrically conductive platen adapted to support an image receiving carrier member;

a corona source adapted to spray ions toward said image receiving member;

a corona modulating screen disposed between said corona source and said image receiving member;

a toner carriage screen positioned between said modulating screen and platen, said screen having a high resolution of small openings for holding toner particles clinging thereon and bridging said openings, said screen having a conducting core with an insulating coating; and means for impressing an electric field between said corona source and said modulating screen of a first magnitude, and a similar field between said corona source and platen of a greater second magnitude for impressing toner particles on said carriage screen with a charge corresponding to said corona and in a pattern determined by said modulating screen, thereby propelling those toner particles toward said platen which have been charged by a corona ion passing said modulating screen.

* * * * *